US005169580A

United States Patent [19]

Marcus

[11] Patent Number: 5,169,580

[45] Date of Patent: Dec. 8, 1992

[54] BONDED NON-WOVEN POLYESTER FIBER STRUCTURES

[75] Inventor: Ilan Marcus, Versoix, Switzerland

[73] Assignee: E. I. Du Pont de Nemours and Company, Wilmington, Del.

[21] Appl. No.: 714,874

[22] Filed: Jun. 13, 1991

Related U.S. Application Data

[63] Continuation-in-part of Ser. No. 549,847, Jul. 9, 1990, abandoned, which is a continuation-in-part of Ser. No. 290,385, Dec. 27, 1988, Pat. No. 4,940,502, which is a continuation-in-part of Ser. No. 921,644, Oct. 21, 1986, Pat. No. 4,794,038, which is a continuation-in-part of Ser. No. 734,423, May 15, 1985, Pat. No. 4,618,531.

[51] Int. Cl.[5] ..... D04H 3/16

[52] U.S. Cl. ..... 264/115; 264/126; 428/288; 428/296

[58] Field of Search ..... 264/115, 126; 428/288, 428/296

[56] References Cited

U.S. PATENT DOCUMENTS

| | | | |
|---|---|---|---|
| 4,663,225 | 5/1987 | Farley et al. | 428/296 |
| 4,783,364 | 11/1988 | Ilan | 428/299 |
| 4,814,229 | 3/1989 | Tesch | 428/402 |
| 4,820,574 | 4/1989 | Tesch | 428/402 |
| 4,911,980 | 3/1990 | Tesch | 428/400 |
| 4,917,943 | 4/1990 | Tesch | 428/402 |
| 4,940,502 | 7/1990 | Marcus | 428/296 |
| 5,080,964 | 1/1992 | Tesch | 428/224 |

*Primary Examiner*—James J. Bell

[57] ABSTRACT

A batch process and apparatus are provided for molding fiberballs, comprising load-bearing fibers and binder fibers, into shaped articles, preferably using hot air within a perforated mold to allow circulation of the air through the fiberballs. The techniques are particularly adapted to molding cushions of varying shapes and sizes, without excessive wastage of material, using relatively simple flexible equipment.

12 Claims, 5 Drawing Sheets

BONDED NON-WOVEN POLYESTER FIBER STRUCTURES

CROSS REFERENCE TO RELATED APPLICATION

This application is a continuation-in-part of my parent application Ser. No. 07/549,847, filed Jul. 9, 1990 is now abandoned, which is itself a continuation-in-part of my application Ser. No. 07/290,385, filed Dec. 27, 1988, now issued as U.S. Pat. No. 4,940,502, which is itself a continuation-in-part of my application Ser. No. 06/921,644, filed Oct. 21, 1986 now issued as U.S. Pat. No. 4,794,038, itself a continuation-in-part of my application Ser. No. 734,423, filed May 15, 1985, now issued as U.S. Pat. No. 4,618,531.

1. Technical Field

This invention concerns improvements relating to bonded non-woven polyester fiber structures, and more particularly to a new process and apparatus providing novel bonded polyester fiber articles from fiberballs of the polyester fiber blended with binder fibers (of lower melting and softening point than the load-bearing polyester fiber), that are bonded to provide useful new through-bonded articles of improved structure.

2. Background of the Invention

Thermally-bonded polyester fiber structures were described in my U.S. Pat. No. 4,794,038 (and in many other documents, including, e.g., U.S. Pat. No(s). 4,668,562 and 4,753,693, and WO 88/00258, corresponding to Ser. No. 880,276, filed Jun. 30, 1986). Binder fibers can be intimately blended into the load-bearing polyester fiber to achieve true "through bonding" of the polyester fiber when they are suitably activated. "Through bonding" has provided higher support and better durability than resin-bonding of polyester fiber (which used to be the conventional method of bonding), and can also provide reduced flammability than conventional resin-bonding. Binder fiber blends had already been used to make batts in furnishing, mattresses and similar uses where high support and good durability were required. They had seldom been used as the only filling material in these end uses, but the common practice was to use the polyester fiber batts as a "wrapping" around a foam core. It is believed that the main reason was that it has been difficult to achieve the desired properties without using such foam core. To achieve the desired resilience and durability, bonded fiber batts would have had to reach high densities, in the 35 to 50 kg/m$^3$ range. Such high densities could not be achieved commercially until more recently. Even then, such condensed (i.e. high density) batts as had appeared on the commercial market in Europe and the U.S. (e.g., in 1987) were nonuniform in density, lower layers being denser than upper layers, which resulted in increased loss of height during use. These high density "block batts" or "fibercores" (as they have sometimes been referred to) were also characterized by relatively poor conformation to a user's body. I believe that this resulted from their structure, since the batts were made from a series of superposed parallel layers; when these parallelized structures are deformed under pressure, they tend to pull in the sides of the whole structure rather than to deform more locally, i.e., to conform to the shape and weight of the user's body, as would latex or good quality polyurethane foam.

Thus, the performance of existing "block batts" made wholly from bonded polyester fiber had not been entirely satisfactory. The difficulty had been how to combine in one structure both durability and conformability to a human body. To obtain durability, while existing "block batts" from superposed carded webs, one had to increase the density until one obtained a structure that did not conform as comfortably as other structures, i.e. not wholly from bonded polyester fiber. I solved this problem according to the invention of my copending patent application, Ser. No. 07/290,385 (the disclosure of which is hereby incorporated herein by reference) by providing a continuous process and an apparatus for making molded blocks of bonded polyester fiber from a blend of polyester fiber and binder fiber.

An essential element of the solution to the problem was to use a binder fiber blend in a 3-dimensional form, as fiberballs, rather than a flat web or as a formless mass of fibers. Preferred fiberballs (and their preparation and bonding) are the subject of my U.S. Pat. No. 4,794,038, referred to above, the disclosure of which is also hereby incorporated herein by reference, it being understood, however, that other fiberballs may be used, if desired.

A continuous process such as I disclosed in my copending application Ser. No. 07/290,385 is excellent for producing mattress cores, or similar furnishing products that are flat and rectangular, or whose width varies only slightly within a limited range, so such furniture styles may be continuously produced on a large scale with little variation in cross-section.

Some furniture cushions are, however, designed in shapes which are not flat and/or not of rectangular cross-section. The specific shapes may be required infrequently, and/or on a relatively small scale. For such cushion styles, a continuous molding process, such as disclosed in my copending application, Ser. No. 07/290,385, may not be so appropriate. It is excellent for producing continuously, a structure whose dimensions are not modified at all, or within certain limits only. The process and the apparatus disclosed in the copending application is also very useful for the production of condensed fiber structures of relatively large size, such as mattresses. If, however, furniture cushions or automotive seats were made using the continuous process disclosed under my copending application, there would be significant losses of waste material, as the large regular pieces would have to be cut to the various sizes and the shapes of the cushions, as is done today with foam. This would not only increase the cost, due to the weight losses, but would also limit the flexibility of the operation.

Accordingly, the object of my present invention is to provide a simple and flexible process and apparatus suitable for producing cushions, e.g. by directly molding fiberballs into the final shape for the cushion or other furnishing products, if this is desired.

SUMMARY OF THE INVENTION

According to one aspect of the invention, there is provided a batch process for molding shaped articles of load-bearing fibers by first heating and then cooling in a mold a blend of binder fibers and load-bearing fibers, wherein (1) the binder fibers and load-bearing fibers are formed into fiberballs, (2) the fiberballs are loaded into a mold, to form an assembly of fiberballs, (3) the binder fibers are activated by hot air which is forced through the assembly of fiberballs in the mold, and wherein sealing means are provided around the assembly of fiberballs to ensure passage of the hot air through said assembly. Such process provides flexibility as several variants are practical and useful, depending on what is desirable commercially, as I indicate in more detail hereinafter. Preferred load-bearing fibers are cut polyester fibers of suitable denier such as have been used in various filling applications, because of their resilience and the good support provided. Reference may be made to the literature, e.g. as referred to, especially such as is incorporated herein by reference, for more detail on suitable polyester fibers, binder materials and binder fibers. As will readily be understood, suitable binder fibers include bicomponent binder fibers, e.g. of sheath-core or other type. The cores thereof may provide all or part of the load-bearing fibers, as desirable according to the particular end-use and properties desired in the shaped article.

As will be apparent hereinafter, a particularly important aspect of my invention is the new cushions that are provided by my new process. These new cushions are preferred shaped articles according to the invention. The term cushions is used broadly herein, including, for instance cushion cores that may be used as support within a wrapping of one or more layer(s) of their material(s) to provide different surface aesthetics. As indicated herein, such new cushions may be characterized by a density from about 18 to about 45 kg/m$^3$, and yet be entirely derived from fibers (load-bearing fibers bonded by the binder material from the binder fiber used). They may also be defined by their superior air permeability, generally at least 1200 l/m$^2$/sec, and preferably at least 2000 l/m$^2$/sec, and/or water transport as shown by recovery within 1 minute of at least 50% of a portion of 100 ml of water poured onto a sample enclosed in a fitting plastic box, by the test method disclosed herein, using samples 10 cm thick, or values adjusted to correspond with such a thickness of 10 cm.

Further aspects of the invention are the new molds and other equipment described herein. Such molds are particularly adapted for heating with hot air, and so are formed from grids and/or plates, including moving or movable belts, that are perforated to permit circulation of hot air therethrough for heating to activate the binder material, and then for cool air for subsequent cooling. The molds are preferably supported on frames, and heated in ovens, as more particularly described hereinafter.

BRIEF DESCRIPTION OF DRAWINGS

FIGS. 2A and 2B shows perspective views of individual parts separately. FIG. 2D shows an elevation view of the parts of a representative mold as they would be assembled together. FIG. 2C shows the same parts as in FIG. 2D, but exploded, so each part may be seen more clearly in relation to cooperating parts, all as described more particularly hereinafter.

DETAILED DESCRIPTION OF THE INVENTION

Figure 1:
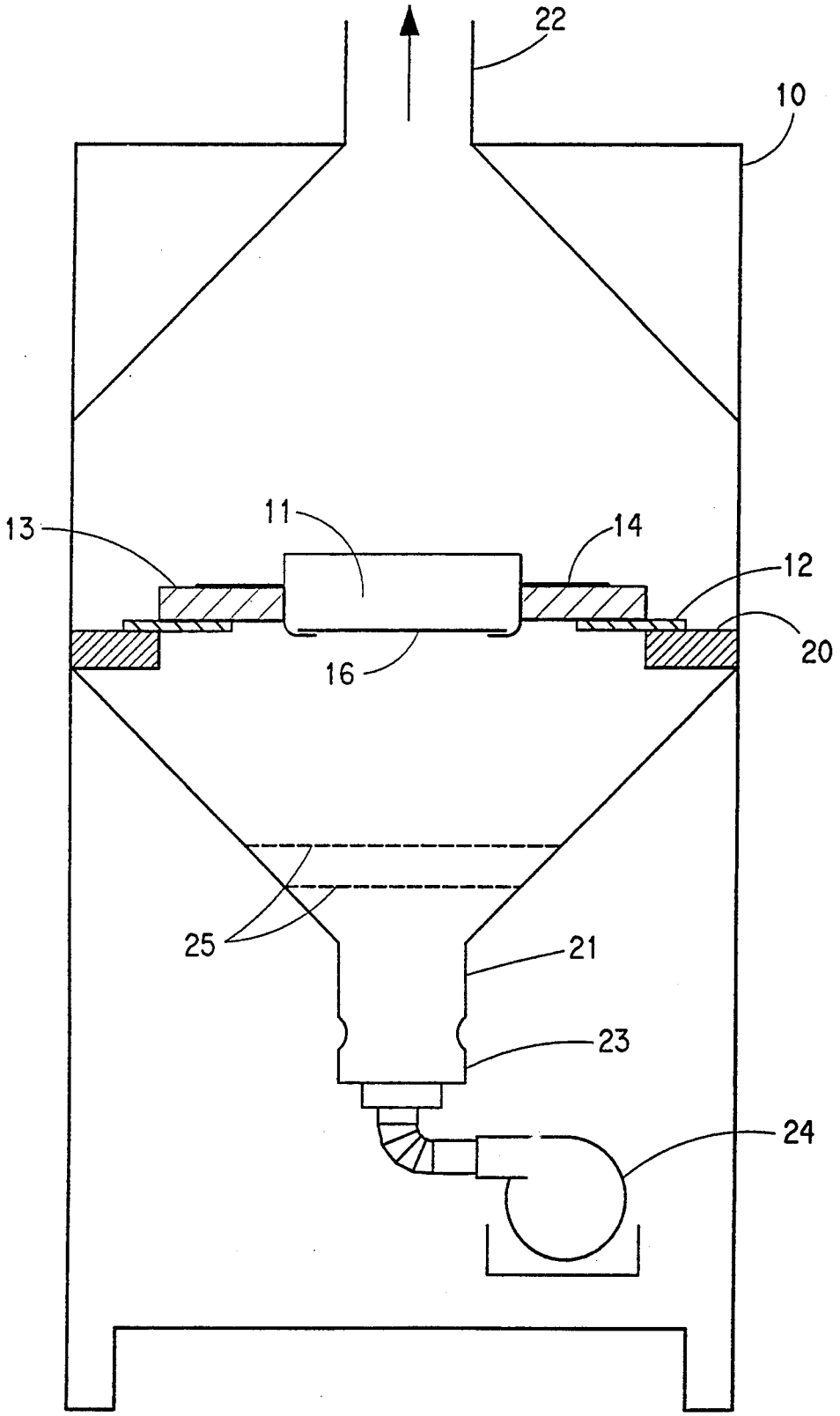
FIG. 1 illustrates schematically an elevation view of an apparatus according to the invention.

According to the invention, articles (referred to often herein as cushions) having a predetermined shape and dimensions are molded from polyester fiberballs, preferably made from blends of binder fiber and load-bearing fibers, the binder fiber being activated by hot air, microwave (MW) or high frequency (HF).

The balls may be made from a blend of the feed fiber by opening the feed fiber and then submitting to a rolling action by methods disclosed in the art; e.g. my U.S. Pat. No. 4,794,038 or copending application Ser. No. 07/508,878 filed Apr. 12, 1990 by Snyder et al, the disclosures of each of which is hereby specifically incorporated herein by reference.

The fiberballs are preferably sufficiently rolled to produce an effective fiberball structure with a three dimensional fiber arrangement. The use of fiberballs is important to provide good distribution throughout the molding apparatus, and uniform density and good resilience and durability in the molded articles, as indicated later herein. Unlike requirements for other fiberballs, for the purposes of the present invention it is often preferable to use fiberballs having a significant degree of hairiness, i.e. a relatively high cohesion measurement as described in my earlier U.S. Pat. No. 4,168,531, so that, when molded, they bond well together (good fiberball to fiberball bonding).

The mold is placed in an oven, and is preferably supported by a frame, to simplify loading and unloading of the mold. The fiberballs may be fed directly into the mold, where they are molded by activation of the binder, or be fed into a ticking which is placed in the mold. In both cases, the fiberballs may be heated in the closed mold, i.e. the parts of the mold form the initial and final dimensions of the cushion, as it cools. Alternatively, they may first be heated while confined under a low pressure, or no pressure at all, at a higher thickness (i.e. height) than the final cushion thickness. Then the lid of the mold may be pushed down, as desired, to the predetermined dimensions after the binder has been activated, and the material is cooled by sucking air through the mold with the desired dimensions. Such a procedure provides for more throughput, as the oven may be used again for heating another mold, while previous molds are cooling, but enables faster heating of the fiberballs at a lower density.

It is important that the air be forced through the fiberball assembly. This is preferably achieved by sealing the area between the mold and the frame which carries the mold or, if no frame is used, the oven walls.

While the use of molds may be of help, by giving a desired shape to a cushion, and particularly to its sides, by producing a good, regular, surface, it is not essential. A mold is highly desirable for forming cushions which are going to be used directly as the finished product.

In furniture, however, it is a common practice to wrap the core (hitherto such cores have usually been of foam) with a batt of fibers. In such a case, it is not necessary to provide aesthetically perfect sides of the cushion, so another (less costly) technique (which can be called "open molding") may be used, as follows. The fiberballs are sucked into a non-woven or similar ticking, and this "cushion" may be closed and placed on a perforated plate with all the area around this "cushion" sealed by a plastic foil or other heat-resisting material. An upper perforated plate, is fixed above the cushion at a predetermined distance from the lower plate. Hot air is then blown through the structure. As with the closed molding technique, it is possible to heat and cool such a cushion directly to its final thickness without changing its dimensions, or to shape it by lowering the upper perforated plate, which acts like a "lid" of this open mold, i.e. there is little or no confinement of the fiberballs as they are heated, as there are no sidewalls. Another possible variation is to cool the cushion with a lid shaped as desired, e.g. with a curved or otherwise specially sculpted surface.

The mold is placed (loaded) in an oven having an air inlet on one side of the mold (preferably below the mold) and an air outlet on the other side (preferably above the mold). Loading and unloading is preferably done horizontally, e.g. by a sliding door which is coupled with the loading and unloading mechanism. The oven is preferably arranged so that the air inlet is centered and the air is directed perpendicularly to the mold, and the air outlet is symmetric to the inlet.

To provide good control of the air flow, and thus control over the temperature, it is generally desirable to have very directional air flow. To ensure good and uniform bonding of cushions with a large area, however, I have placed between the air inlet and the mold several layers of perforated plates with the air holes displaced versus each other, to break up the air stream and distribute the air more uniformly.

The system allows fiberballs to be molded directly into cushions, if desired, without losing material by cutting the cushion to shape, which can constitute a major economic advantage. The cushions also can be made with uniform density even when they have a very sculptured surface, unlike cushions that have been molded from batts (made from similar fiber blends), which generally have a significantly higher density in the troughs than in the peaks.

The process and equipment are inexpensive and flexible, allowing one to custom-produce cushions with various shapes and sizes at the same time. For custom-molding, I use a custom-mold (of the desired dimensions) made from perforated plates or grids, and mounted on a frame of metal bars supporting a "skirt" made of a temperature-resistant relatively thick plastic foil, or of metal, of appropriate size so as to avoid leaving any gap between the frame and the mold. This skirt forces the hot air to pass through the mold and thus allows one to produce a variety of cushions which differ from each other in size and/or shape in the same oven using a standard frame.

The same principle applies to "open molding", whereby a "cushion" of whatever dimensions desired may be placed on a perforated plate or a grid, with the area around its base sealed by an appropriately sized metal or a heat-resistant plastic skirt, to force the air through the cushion. The lower perforated plate may be replaced by a perforated belt, which may serve to load and unload the cushions, e.g. by intermittently moving into the oven, stopping there for a timed period, and then moving on. For instance, the belt may serve to bring the cushion to a cooling zone and from there to an unloading zone. The upper part of the cushion can be shaped by the upper plate in the cooling zone prior to cooling and consolidating the structure. The skirt may conveniently be located just beneath the belt and can be made of polyester, polyamide, special rubber or other materials which can resist hot air at temperatures of about 150° to about 180° C.

Such equipment and techniques are simple, flexible, require little investment, and allow one to increase capacity as desired.

The resulting cushions are characterized by outstanding durability, that is achievable at lower density than from condensed batts using the same feed fibers. My cushions are also characterized by high support, with good conformation to the user's body. I believe that these advantages result from the internal structure of these cushions: the fiber arrangement within each fiberball (which arrangement has been stabilized by the bonding) has a significant vertical component which provides support, while the bonding forces between the fiberballs may be lower, and may allow limited relative movements of the fiberballs within the structure, if desired.

My cushions are characterized also by much better (higher) water transport through the cushions than condensed batts made from the same feed fibers at the same density and the air permeability is at least comparable. The improvement is believed to be related to the interstices, e.g. between the fiberballs, and the improved fiber arrangements, more generally. The water transport can be enhanced by coating the fibers with hydrophilic permanent coatings, such as those disclosed in my earlier U.S. Pat. Nos. 4,783,364 and 4,818,599 and my co-pending application Ser. No. 07/435,513, filed Mar. 17, 1989, the disclosures of each of which is hereby specifically incorporated herein by reference.

These properties of my cushions make them particularly suitable for furnishings, e.g. in homes, and in automotive and garden applications, by way of example.

According to one embodiment of the invention the fiberballs may be sucked or blown into a ticking, which is then closed and placed in the bottom of a perforated mold.

According to another embodiment of the invention the mass of the fiberballs may be heated without any. pressure applied, the heated mass may then be pressed to the predetermined shape and dimensions by the upper part of the mold, which may also be perforated, and cooled by sucking cold air through the mold. The cushion is then taken out of the mold and can either be used directly or, if so desired, the ticking can be recovered and recycled. According to another embodiment of the invention the ticking filled with the fiberballs may be placed in a closed mold and the binder fiber is activated, to produce the cushion to its final dimensions.

According to another variant of the invention the filled ticking may be placed on a perforated plate or a grid with the area between the cushion and oven walls completely closed. The binder fiber may then be activated by hot air and the cushion is cooled between two perforated plates or in a mold to shape it. The cushion can also be heated between two perforated plates. The presence of the upper plate will usually make the upper part of the cushion firmer and will improve the bonding of the sides of the cushion.

According to still another embodiment of the invention the fiberballs may be sucked directly into the bottom of the mold, the binder may be activated and the mass of fiberballs may be compressed to its final dimensions and cooled by sucking air through the mold. To facilitate the unmolding of the cushion the bottom part of the mold should preferably have a removable base, which can be pushed upwards to free the molded piece.

The binder fiber is preferably activated by hot air. This hot air may be forced through the mass of fiberballs in the mold to achieve effective bonding within a short heating cycle. To ensure that the air passes through the fiberballs within the mold, their periphery around the mold should be completely sealed. This can be achieved by surrounding the mold with a heat-resistant plastic sheet or metal plate to fill any gap between the mold and the frame which carries it.

Because of the variety of shapes and sizes of furnishing cushions and of the limited number of cushions produced in each size and shape, sealing this periphery, i.e. avoiding any gap between the various molds and the frame could involve complications. In a commercial operation, it is possible to produce and store plates and frames to suit each and every cushion produced; this involves the cost and the time needed to produce and change sufficient frames and plates. I have therefore developed a solution to this problem which ensures that the gap between the molds and the oven walls are sealed and eliminates the need to have different plates or frames for each and every cushion. My invention also provides a system which allows me to change easily the cushion shape, or even to produce cushions with completely different shapes, if so desired. A special oven for the molding of the fiberballs according to the invention was also developed. The oven consists of two chambers with frame and the mold placed between them. The oven is preferably perpendicular.

The hot air is introduced from the bottom or the upper part of the perpendicular oven and forced to pass through the mold, by sealing the space between the mold and the carrying frame. The frame is introduced through a sliding door into the oven and the hot air is injected. To save energy, the hot air can be collected, re-heated to the working temperature, and recycled. The heating cycle depends on many factors: The density of the fiberball mass, the air temperature, the air flow, the resistance of the mold and the perforated plates to the air flow, and the temperature of the oven chamber. After the completion of the heating cycle the mold is unloaded, the upper part of the mold is pressed down to the desired height of the cushion and cold air is sucked through the structure to cool the cushion to about the room temperature. The working temperature depends on the binder fiber and is preferably not higher than 185° C. For economic reasons it is desirable to work with a high air flow, and thus to minimize the duration of the heating cycle.

Preferably, according to the invention, a frame carries the mold and provides a large amount of open space. The frames can be interconnected, mounted on chains, or a rotating system, so that a continuous or a semi-continuous process can be achieved. The frames carry the lower part of the molds, which may be supported directly by such frame, or conveniently lay on bars which extend from the mold. The space between the mold and the frame is covered by sealing means, preferably a metal or plastic sheet which is welded, glued or otherwise bonded to the support bars.

With the "open mold" technique, the frame simply supports the perforated plate and the cushion, while the gap between the oven walls and the cushion is sealed by a plastic foil or metal sheet or a similar material. This may be provided by using a belt, for transplanting the cushions, such belt being perforated, e.g. perforated metal plates, or a grid made of aramid fibers, suitably coated, if desired, e.g. with a "non-stick" coating.

The frames are placed in an oven, equipped with a precise control of the air flow and air temperature. The oven may also be equipped with thermocouples to monitor and provide means to control the air temperature at different parts of the oven. I have found that the key points to place these thermocouples are the air inlet, preferably just below the mold, and the air outlet. Other thermocouples can be placed at other parts of the mold to allow control of the temperature uniformity. To achieve good control of the temperature and the flow it may be necessary to direct the air flow. If, however, this should cause non-uniform heating of the cushion, resulting in a non-uniform hardness, this problem can be avoided by using between the air inlet and the mold a series of properly-spaced, parallel, perforated plates with the holes displaced versus each other, to break the air flow, as known in the art. The bottom part of each mold may be equipped with metal bars which bridge the space between the mold and the frame which carries it. A plastic skirt, made of a thin heat resistant film, which fills the gap between the mold and the frame, may be fixed on the metal bars. The invention allows one to have one set of frames installed permanently with their loading and unloading system and produce whatever cushions are required by changing the mold, or the shape of the filled cushion. The sealing of the system is ensured by the mold's skirt. The skirt can be easily cut from an appropriate plastic film.

Referring more particularly to the drawings, a preferred apparatus according to the invention is illustrated schematically in FIG. 1. The apparatus, generally, may be referred to as an oven 10, within which is located a mold 11. The frame 12 is itself supported by lugs 20 or other suitable fixed supports attached to the internal wall of ovens 10. A fitting skirt 13 is provided to seal the space around the periphery of mold 11. The skirt 13 overlaps the frame 12, and is held in place by the bars 14. Mold 11 has a removable base 16 that is perforated to allow air to pass through the mold from an inlet 21, being supported by a lower fan 24, after being heated by a heater 23, and is exhausted at the top through an outlet 22. Perforated plates 25 are provided to act as baffles and provide better distribution and uniformity of the air flow, because of the lateral displacement of the perforations.

Figure 2A:
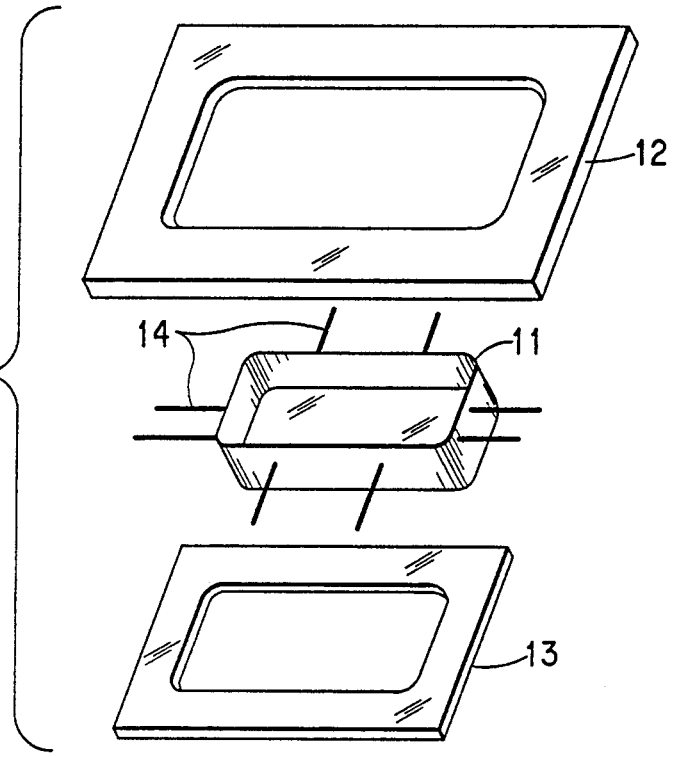
FIGS. 2A, 2B, 2C, and 2D show several views of various parts of representative molds according to the invention.
Figure 2B:
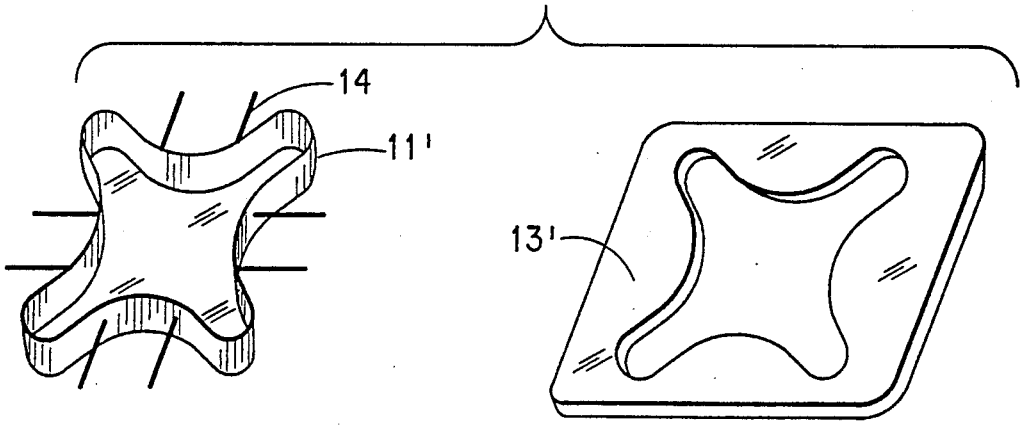
Figure 2C:
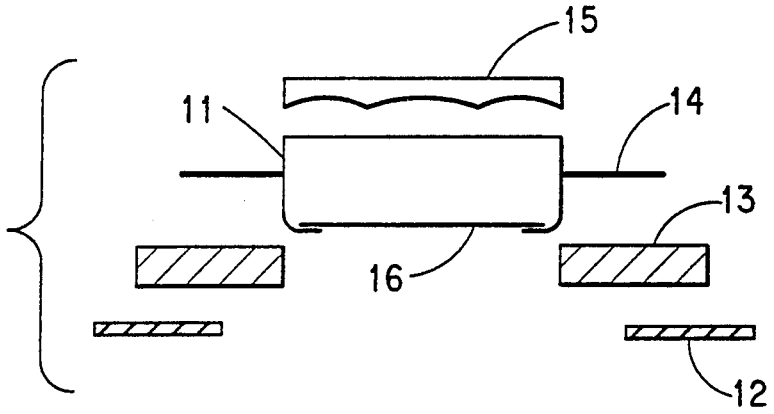
Figure 2D:
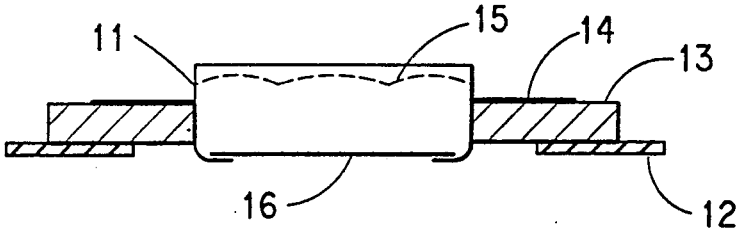

Various parts associated with mold 11 are shown in more detail in FIGS. 2A, 2B, 2C and 2D. FIG. 2D shows the various parts assembled more or less as in FIG. 1, while FIG. 2C shows an exploded view of the same parts (which are shown individually, in perspective, in FIG. 2A). In FIG. 2D, frame 12 supports skirt 13, on which rest bars 14 protruding from mold 11, which is shown also with lid 15, and removable base 16, both of which are perforated (such perforations not being shown). Mold 11 and skirt 13 are each shown in FIG. 2A as having an essentially square cross-section, but different cross-sections may be used as shown, for instance, in FIG. 2B. FIG. 2B shows mold 11 with a cross-section like a 4-leaf clover, and with correspondingly shaped skirt 13. Thus it will be understood that widely different shapes of cushions made be produced in the same oven merely by varying the shape of the mold and its conforming peripheral skirt.

Figure 3:
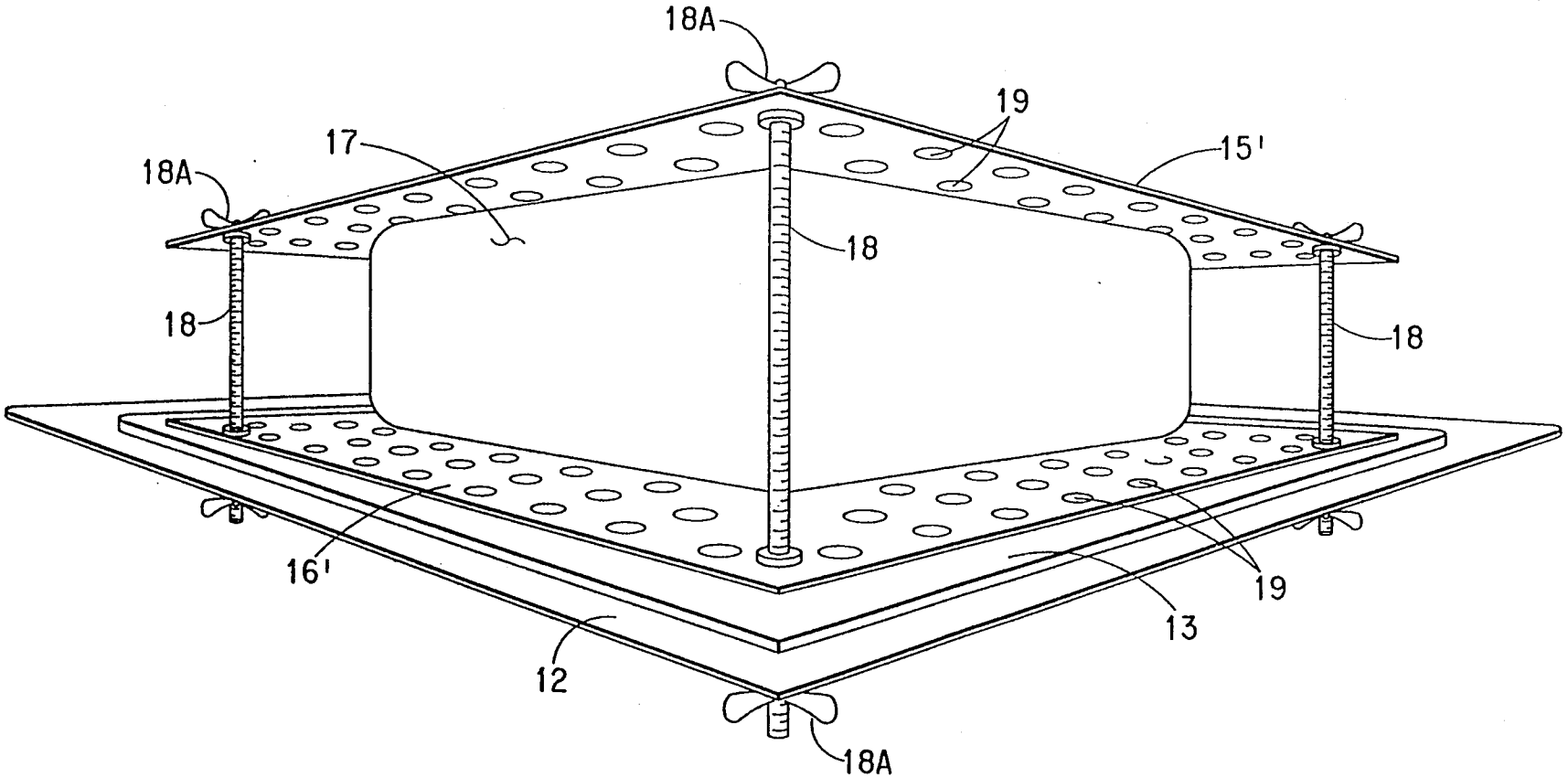
FIG. 3 shows a view in perspective of the parts of an "open mold" assembled together, as described hereinafter in more detail.

FIG. 3 shows a perspective view of the "open mold" concept, whereby the fiberballs are first loaded into a ticking of the dimensions desired (these may be those desired for he final cushion), and then the binder fiber is activated by hot air as the cushion is located between upper and lower perforated plates, or grids if desired. Thus, starting from the bottom of FIG. 3, frame 12 is shown supporting skirt 13 as before, with a perforated plate 16' acting as a base for cushion 17 (before activating the binder with hot air, this is generally ticking loaded with fiberballs and then closed) that is located between upper plate 15' and lower plate 16', which may be secured together at each corner by threaded rods 18 that are adjusted to the same length (so as to maintain uniform thickness for the fiberball assembly, i.e. the cushion) by adjusting the positions of butterfly nuts 18A, as shown. Perforations 19 are provided in both upper plate 15' and lower plate 16' (only some representative perforations being shown in the drawing). Suitable dimensions may be as follows: frame 12, of thickness 10 mm and shaped as an open square in cross-section, with an outside length of 800 mm and an inside length of 650 mm; skirt 13, of thickness 50 mm and shaped as another open square in cross-section, with an outside length of 750 mm and an inside length of 600 mm; lower perforated plate 16' of thickness 1.5 mm, and being a square, each side being of length 700 mm, and with perforations of diameter about 3 mm, spaced 2 mm apart; cushion 17 being of square cross-section with sides 600 mm long (to fit the inside length of skirt 13), and of whatever thickness is desired; upper plate 15' may be like bottom plate 16'.

Figure 4:
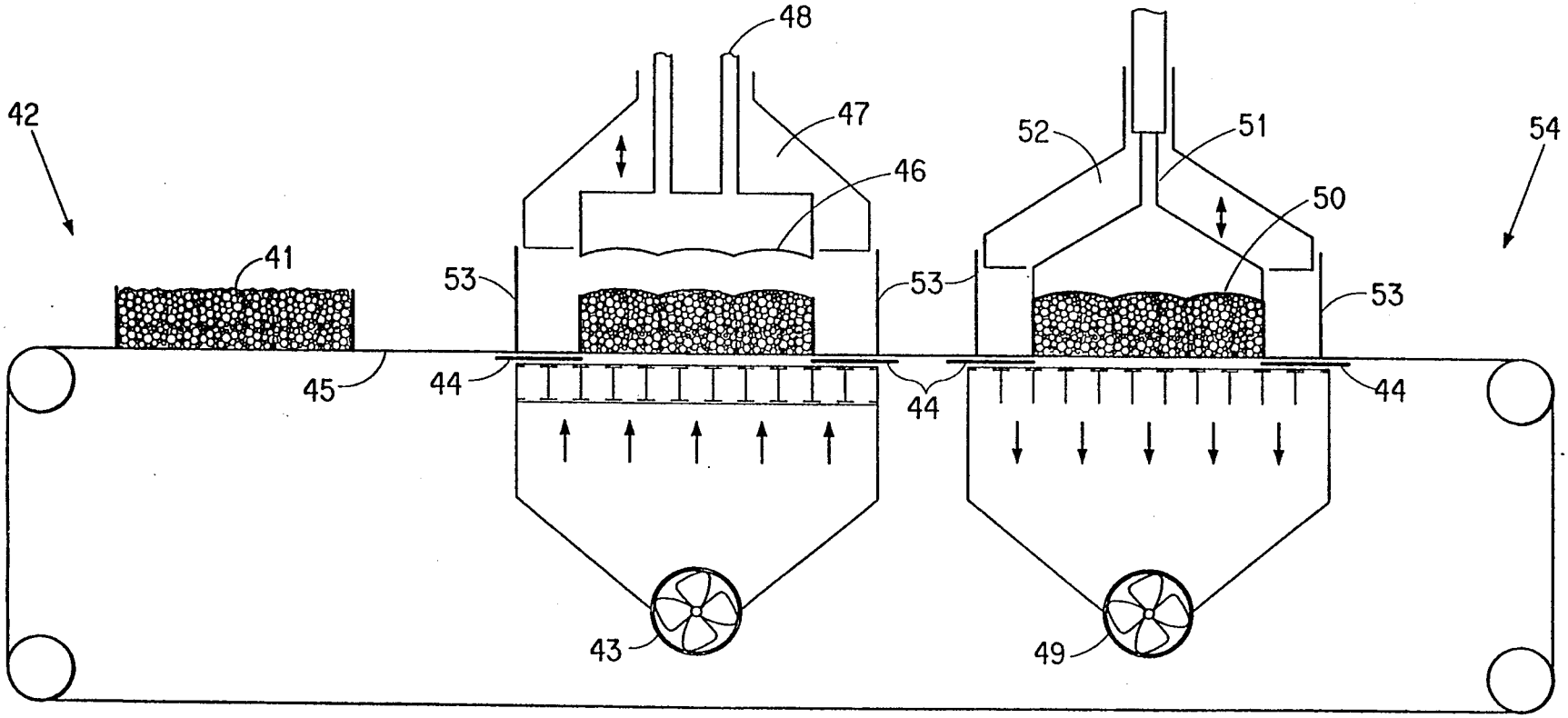
FIG. 4 illustrates schematically a semi-continuous apparatus according to the invention.

The open mold concept can easily be automated to reduce labor cost by replacing the lower plate 16' by a belt, e.g., as shown in FIG. 4. This process concept allows one to use separate zones, as shown by heating zone 47, and cooling zone 52 with a belt 45, going through, transporting the cushion 41 from loading zone 42 to the heating zone 47, then to the cooling zone 52 and finally to unloading zone 54.

The molding is done by injecting hot air (using, for example, fan 43) through the belt 45 into the cushion which is between the belt and upper plate 46, attached to a piston 48 to lower and release the upper plate as required by the operation. The upper plate is usually a perforated metal plate which can be either flat or shaped to the shape of the cushion, depending on the cushion design. Usually, for designs with a small to moderate difference between the highest and the lowest points on the cushion surface, it is not necessary to use a shaped upper plate. For such cushions it is possible to achieve satisfactory results by heating the cushion between the belt and a flat plate and forming it prior to cooling in the cooling zone.

As in the case of the open mold disclosed in FIG. 3, to achieve a fast and effective molding it is important to use a sealing means, such as skirts 44 to block the hot air from escaping through the part of the belt which surrounds the cushion. The skirt can be made of polyester, polyamide sheets, special rubber, or other materials which resist a temperature of up to about 180° C. It is conveniently placed beneath the belt in the heating zone and can be either fixed on metal frames, which can be slided into a horizontal slot located just beneath the belt, or can be cut in a roll of continuous sheet which can be rolled and unrolled, perpendicularly to the belt, to position the appropriate skirt beneath the belt.

To save energy, both the heating and the cooling zones can be equipped with automatic sliding doors 53 which open to let the cushion in and out and close during the heating and cooling operation. An advantage of this embodiment is that heating and cooling can be done at the same time on two different cushions.

As in the case of the open mold disclosed in FIG. 3, the upper part of the cushion can be shaped prior to and during cooling, using a shaped upper plate 50 in the cooling zone. As in the heating zone, the upper plate 50 is attached to a piston 51, which allows the plate to move up and down to shape the cushion prior and during cooling and then release it after the cooling cycle. The cooling zone 52 may be equipped similarly to the heating zone, e.g., with fan 49, and another skirt 44.

DESCRIPTION OF TEST METHODS

Bulk measurements were made conventionally on an Instron machine to measure the indicated heights (in mm) of the cushion (size 50 cm×50 cm×10 cm) as a function of the compression forces, when compressed with a foot having a diameter of 10 cm. After one compression cycle (during which no measurements are made), the following values are recorded during a second compression cycle:

$IH_2$: initial height, the height of the cushion at the beginning of the second cycle.

Support bulk (SB or 7.5 N): the height under a 7.5 N force.

Bulk 60 N (B or 60 N): the height under a force of 60 N.

The softness is calculated both in absolute terms (AS, i.e. $IH_2$-7.5 N) and in relative terms as a percentage of the initial height (RS, i.e. AS expressed in percent of $IH_2$).

A firm cushion corresponds to a high support bulk, i.e. inversely with softness.

Resilience is measured as work recovery (WR), i.e. the ratio of the area under the whole recovery curve calculated as a percent of that under the whole compression curve. The higher the WR, the better the resilience.

Durability

Each cushion was covered with a polyester spun bonded non-woven, weight 18 g/m$^2$.

The various compression values of these cushions were measured and recorded (as BF, before flexing) values, and these are listed in Table 3A. The cushion was then submitted to 10,000 successive flexings, under a pressure of about 133 g/cm$^2$ at a rate of 1400 cycles/-hour nd the compression values were measured again and recorded (as AF, after flexing). The changes are shown in Table 3B as percent losses from the BF values.

Measurement of Water Transport

The object of this test is to measure how fast water runs through the structure. A high value can be important for such applications as garden furniture cushions, boat cushions, and car seats. As there has been no standard method to measure this property on such thick products, the following method was developed by modifying a geotextile test. With thick products of the invention, foam blocks or similar products, the water would tend to run out through the sides of the block, rather than pass through. So, the equipment was modified, and the test piece of cushion was a plastic box, as described below. Before introducing the cushion, the side walls of the plastic box are covered with a thin layer of high viscosity silicone oil. A 15×15 cm block, 10 cm thick, is cut from the material to be tested and placed in the plastic box in the equipment. The box is then closed by a plastic lid having a hole with a diameter of 150 mm. 100 ml of water are poured in one shot through this hole onto the upper part of the test block, the water is collected into a measuring glass cylinder and the amount of water collected is recorded as a function of time. I have made cushions according to the invention that have had sufficient water transportability to allow within one minute more than 50% of such 100 ml of water, which is an excellent result and superior to the prior art.

Measurement of the Air Permeability

Again, there was no existing method for measuring such thick blocks. So, an air permeability test for fabrics was modified by placing the block in a closed box having a small diameter air inlet and outlet to channel the air flow through the middle of the block and avoid air flow through the sides of the block.

A similar block of the cushion to be tested having dimensions of 15×15×10 cm is placed in a plastic box of 15×15 cm, having a round hole in its base of diameter 15 mm. The box is closed with an upper part which closes hermetically on the bottom part, and has a round hole with a similar diameter of 15 mm. Air is sucked through the hole in the base after inserting a flexible plastic tube (diameter 40 mm) connected to an Air Permeability Tester (produced and sold commercially by Textile Testing Instruments in Zurich, Switzerland). The air permeability is measured under the standard conditions used for measuring the air permeability of fabrics, and is recorded as $l/m^2/sec$ (i.e., liters per square meter per second) for such a thickness of 10 cm. I have prepared cushions according to the invention having air permeability of more than 1200 $l/m^2/sec$ (for such 10 cm thickness) which is an excellent value.

High air permeability is generally desirable, so long as the cushion provides adequate support.

The invention is further described in the following Examples. It will be noted that, for comparative purposes, cushions were made from similar blends without first making fiberballs, and each of these is labeled "Comparison". All parts and percentages therein are by weight, based on the fiber, unless otherwise stated. The molds used for these tests have a flat upper and lower part and a rectangular shape that has rounded corners and edges. This shape was used so as to facilitate measuring the air permeability and water transport in the resulting cushions, so as to demonstrate the advantages in these properties of cushions made according to the invention.

Comparison A

This item was not according to the invention, but only for purposes of comparison.

A blend of 80% of a 13 dtex commercial 4-hole (25% void) polyester fiberfill and 20% of a 17 dtex commercial sheath-core polyester binder fiber (50% core/50% sheath by weight) was processed on standard commercial garnetting equipment to produce a batt of density about 450 $g/m^2$. The batt was heated at 165° C. for about 3 minutes and calendered to 40 mm thickness. The batts were cut to squares measuring 50×50 cm, and five and a half of these squares, in layers, layer split horizontally through the middle were piled on the bottom part of the mold, to make 5 layers, plus one layer split horizontally through the middle.

The mold was closed with its upper part to form a chamber with an internal height of 10 cm, and was placed on a frame, which was then put in the oven described in FIG. 1. Hot air at a temperature of 170° C. was injected for 30 seconds (using the Leister lufthitzer type 40,000). The old was unloaded and cooled with air until it reached 30° C. and the mold was opened to produce a molded cushion with a density of about 25 $kg/m^3$ and dimensions of 50×50×10 cm.

Comparison B

The same blend as in Comparison A was used together with the same mold, molding equipment and procedure, but 10 layers of batts were used to produce a cushion having the same dimensions but with 45 $kg/m^3$ density.

Comparison C

A blend of 80% of 13 dtex 4-hole 25% void polyester fiberfill, coated with 0.5% of a (hydrophilic) co(-polyether polyester) and 20% of a 17 dtex sheath-core polyester binder fiber (50% core/50% sheath by weight) was processed on standard commercial garnetting equipment to produce a batt of about 450 $g/m^2$. The batts were then processed as in Comparison A, but with the hydrophilic coating on the load-bearing fibers.

Comparison D

The same blend as in Comparison C was used together with the same mold, molding equipment and procedure, but 10 layers of batts were used as in Comparison B to produce a cushion having the same dimensions but with 45 $kg/m^3$ density.

EXAMPLE 1

A fiber blend as in Comparison C (but with a cut length of 50 mm) was opened and processed on modified card equipment at a throughput of about 50 $kg/m^3$ to produce fiberballs with an average diameter of 5 mm. The fiberball were baled to form a bale with a density of 80 $kg/m^3$. 625 g of the fiberballs were sucked into a light weight spun bonded polyester ticking, having the shape of the cushion to be molded, and the ticking was closed. The filled ticking was loaded into the bottom part of the same mold and the mold was closed at the predetermined height, as in Comparison C, to form a cushion with 10 cm thickness. The mold was heated for 30 seconds, then cooled by sucking cold air through the mold. The mold was opened, and the ticking opened to free the 10 cm thick 25 $kg/m^3$ cushion.

EXAMPLE 2

The fiberballs used in Example 2 were molded in the same mold following the same procedure, but using 1000 g of the fiberballs, to produce a cushion with the same dimensions, but with a density of 40 $kg/m^3$.

TABLE 1

| Item | Density (kg/m3) | Air permeability (l/m2/sec) |
|---|---|---|
| Comparison A | 25 | 3333 |
| Comparison B | 45 | 1000 |
| Comparison C | 25 | 3889 |
| Comparison D | 45 | 1528 |
| Example 1 | 25 | 4028 |
| Example 2 | 40 | 1528 |
| PU foam | 25 | 1666 |
| PU foam | 45 | 1069 |

Table 1 shows air permeability measurements for the above products and foams of comparable density. There was no difference between the air permeability of the densified batt, Comparison D, and the corresponding fiberball block of the same density, Example 2, and there was little difference between Comparison C and Example 1. Comparisons A and B have lower air permeabilities (although they were made from fibers with the same denier), because these fibers were not slickened.

These foams had far lower air permeabilities than the products made according to the invention at the same density. An improved air permeability will help to dissipate excessive body heat, and so will improve the comfort of the user.

TABLE 2

| | Moisture Transport (ml water at 20° C.) | | | | | | | |
|---|---|---|---|---|---|---|---|---|
| | Comparisons | | | | Examples | | PU FOAM | |
| | A | B | C | D | 1 | 2 | | |
| (Densities) | (25) | (45) | (25) | (45) | (25) | (40) | (25) | (45) |
| 10 seconds | 0 | 0 | 20 | 10 | 50 | 13 | 0 | 0 |
| 20 seconds | 0 | 0 | 40 | 15 | 56 | 32 | 0 | 0 |
| 30 seconds | 0 | 0 | 42 | 20 | 58 | 44 | 0 | 0 |
| 40 seconds | 0 | 0 | 43 | 25 | 58 | 48 | 0 | 0 |
| 50 seconds | 0 | 0 | 44 | 27 | 59 | 50 | 0 | 0 |
| 60 seconds | 0 | 0 | 45 | 30 | 60 | 52 | 0 | 0 |
| 2 minutes | 0 | 0 | 47 | 35 | 61 | 58 | 0 | 0 |
| 3 minutes | 0 | 0 | 50 | 40 | 62 | 59 | 0 | 0 |

Comparison A and B (like the foams) retained the water completely and did not let anything pass through, even when the experiment was extended to 15 minutes. The reason is that, due to the hydrophobic character of these fibers, their wetting was poor and the water was retained in the structure, and did not run through. In Comparisons C and D, the water ran through almost immediately. As could be expected the rate was higher for the 25 kg/m$^3$ (Comparison C) than for the 45 kg/m$^3$ batt (Comparison D). The difference from Comparisons A and B was essentially due to the hydrophilic coating of the fibers of Comparisons C and D. The products of the invention (made by molding fiberballs made from the same fibers) gave very significantly faster water transport. The 25 kg/m$^3$ Example 1 retained only 38% of the water after 3 minutes, versus 50% for Comparison C. The transport of the water was almost instantaneous for Example 1, 50% of the water being collected after only 10 seconds versus only 20% for Comparison C.

The water transport of the cushions of the invention depends less on the density, as there is very little difference between the amount of water collected after 3 minutes with the 25 kg/m$^3$ (Example 1) and the 40 kg/m$^3$ (Example 2).

TABLE 3A

| | Before Flex Values | | | | | |
|---|---|---|---|---|---|---|
| | (Heights in mm) | | | | (Percentages) | |
| | IH2 | 7.5N | 60N | A.S. | R.S. | W.R. |
| Comparison A | 89 | 85 | 67.5 | 4 | 4.5% | 81.9% |
| Comparison B | 100 | 95.7 | 79.6 | 4.3 | 4.4% | 76.1% |
| Comparison C | 87 | 78.2 | 51.9 | 8.8 | 10.2% | 78% |
| Comparison D | 96.5 | 88.7 | 68.2 | 7.8 | 8.1% | 78.2% |

TABLE 3A-continued

| | Before Flex Values | | | | | |
|---|---|---|---|---|---|---|
| | (Heights in mm) | | | | (Percentages) | |
| | IH2 | 7.5N | 60N | A.S. | R.S. | W.R. |
| Example 1 | 91.5 | 89.3 | 82.1 | 2.2 | 2.4% | 88% |
| Example 2 | 104.5 | 103.1 | 98.2 | 1.4 | 1.3% | 93.6% |

TABLE 3B

| | Percent Change After Flexing | | | | | |
|---|---|---|---|---|---|---|
| | (Heights in mm) | | | | (Percentages) | |
| | IH2 | 7.5N | 60N | A.S. | R.S. | W.R. |
| Comparison A | −6.2% | −8.5% | −17.5% | +43.9 | +53.3% | −4.6% |
| Comparison B | 0% | −1.6% | −7.8% | +35.1% | +35% | −4.0% |
| Comparison C | −6.9% | −13.4% | −24.5% | +50.9% | +62% | −5.5% |
| Comparison D | −1.6% | −3.2% | −7% | +17.2% | +19.2% | −3% |
| Example 1 | −4.4% | −4.7% | −6.7% | +9.8% | +14.7% | −1.8% |
| Example 2 | −0.1% | −0.9% | −2.3% | +32.9% | +34.8% | −3.6% |

The data in Table 3A shows clearly the high support and resilience (W.R.) of the products made according to the invention.

Example 1 (the cushion of the invention at 25 kg/m$^3$ had a higher support than Comparison D (the condensed batt made from the same fibers at 45 kg/m$^3$). The resilience (W.R.) of Example 1 was substantially higher than that of Comparison B or D, made with a density of 45 kg/m$^3$. Another advantage of the products according to the invention is their durability. Here again, Example 1 had an overall better durability than any of Comparisons A to D, although B and D had a density of 45 kg./m$^3$. The product of the invention made according to Example 2 (at a density of 40 kg/m$^3$) had negligible bulk losses. The apparent high change in percent of the softness corresponds to an absolute change of less than 5 mm.

These results show that cushions according to the invention at 25 kg/m$^3$ provide better support and durability than the Comparisons, even at a density of 45 kg/m$^3$. This is an important economic product advantage, in addition to the low cost of operating the process of the invention.

The Examples hereinbefore gave very good results. However an automated open mold concept as disclosed and illustrated, for example, in FIG. 4, may be preferred for commercial considerations. Such process and apparatus are likely to be preferred whereby a ticking loaded with fiberballs is first placed on a perforated plate (or grid), then this supporting plate is loaded (automatically) into the heating chamber, and then (after a heating cycle) the plate supporting the resulting cushion is removed from the heating chamber into a cooling zone. A belt may be used, if desired, as support for the ticking (and resulting cushion). A suitable apparatus could involve means to synchronize the loading and unloading of the molds, and movement of the molds on their supports into and out of the oven, and cooling locations if desired.

I claim:

1. A batch process for molding shaped articles of load-bearing fibers by first heating and then cooling in a mold a blend of binder fibers and load-bearing fibers, wherein (1) the binder fibers and load-bearing fibers are formed into fiberballs, (2) the fiberballs are loaded into a mold, to form an assembly of fiberballs, (3) the binder fibers are activated by hot air which is forced through the assembly of fiberballs in the mold, and wherein sealing means are provided around the assembly of fiberballs to ensure passage of the hot air through said assembly.

2. A process according to claim 1, wherein the fiberballs are loaded into a mold that comprises perforated plates or grids of high air permeability, and wherein the sealing means is a sheet of metal or plastic thermally stable at 180° C.

3. A process according to claim 1, wherein the mold comprises a base and a lid, and wherein at least part of the base is adapted to be movable, to facilitate release of the molded article from the rest of the mold.

4. A process according to any one of claims 1 to 3, wherein the fiberballs are loaded into a ticking, and the loaded ticking is then loaded into the mold before the binder fibers are activated.

5. A process according to any one of claims 1 to 3, wherein the mold is cooled without change in the dimensions of the mold, after forcing the hot air through the fiberballs.

6. A process according to any one of claims 1 to 3, wherein the thickness of the articles is reduced, after activating the binder, by pushing down the top of the mold before cooling the fibers into their final shape.

7. A process according to claim 6, wherein the mold comprises a bottom part and a lid, and wherein the loaded ticking is placed in the bottom part of the mold, the binder fiber is activated, and then the article is shaped while the binder is above its bonding temperature by pressing down the lid to produce the predetermined shape and dimensions of the article, and then the fibers are cooled to set them in the predetermined shape of the article.

8. A process according to claim 2, wherein the fiberballs are loaded into a ticking, and the loaded ticking is placed on a perforated plate, and wherein the area surrounding the loaded ticking is sealed with plastic or metal sheet sealing means, wherein the air is forced to pass through the assembly.

9. A process according to claim 8, wherein the top side of the assembly is confined by a perforated plate, to shape the assembly during molding.

10. A process according to claim 8, wherein the assembly is shaped after the activation of the binder and before cooling the assembly to its final shape.

11. A process according to claim 1, wherein the mold comprises a bottom part and a lid, and wherein the fiberballs are directly loaded into the bottom part of the mold, and are then pressed by the lid to the final thickness desired for the dimensions of the shaped article, the binder fiber is activated and the assembly is then cooled.

12. A process according to claim 1 or 2, wherein the mold comprises a bottom part and a lid, and the fiberballs are loaded into the bottom part of the mold and the assembly is heated at a thickness which is higher than the final thickness desired for the shaped article, the lid is pressed down to the predetermined desired thickness, and the assembly is then cooled.

* * * * *